US008387844B2

(12) United States Patent
Wrigley et al.

(10) Patent No.: US 8,387,844 B2
(45) Date of Patent: Mar. 5, 2013

(54) HARNESS FOR BREATHING APPARATUS

(75) Inventors: Gordon Wrigley, Tyne and Wear (GB); Paul Townsend, Northumberland (GB)

(73) Assignee: Draeger Safety UK Limited, Blyth (Northumberland) (GB)

( * ) Notice: Subject to any disclaimer, the term of this patent is extended or adjusted under 35 U.S.C. 154(b) by 324 days.

(21) Appl. No.: 12/774,046

(22) Filed: May 5, 2010

(65) Prior Publication Data

US 2010/0282806 A1 Nov. 11, 2010

(30) Foreign Application Priority Data

May 6, 2009 (GB) ..... 0907744.7

(51) Int. Cl.
*A45F 3/04* (2006.01)

(52) U.S. Cl. ..... 224/614; 224/628

(58) Field of Classification Search ..... 224/576, 224/578, 579, 614, 615, 255, 628, 631; 24/197
See application file for complete search history.

(56) References Cited

U.S. PATENT DOCUMENTS

| | | | | |
|---|---|---|---|---|
| 849,282 | A * | 4/1907 | Stukenborg | 2/315 |
| 2,260,060 | A * | 10/1941 | Shaulson | 24/200 |
| 2,943,775 | A * | 7/1960 | Mack et al. | 224/628 |
| 2,990,089 | A * | 6/1961 | Nystrom | 224/628 |
| 3,191,828 | A * | 6/1965 | Senne | 224/604 |
| 3,957,183 | A * | 5/1976 | Gadberry | 224/628 |
| 4,217,998 | A | 8/1980 | Alexander | |
| 4,310,110 | A * | 1/1982 | Dexter | 224/246 |
| 4,842,173 | A * | 6/1989 | Scherer | 224/631 |
| 5,586,699 | A * | 12/1996 | Heisler et al. | 224/628 |
| 6,056,625 | A * | 5/2000 | Fildan | 450/86 |
| 8,002,159 | B2 * | 8/2011 | Cragg | 224/579 |
| 8,146,787 | B2 * | 4/2012 | Cragg | 224/680 |
| 2004/0026901 | A1 * | 2/2004 | Yann et al. | 280/727 |
| 2004/0045991 | A1 | 3/2004 | Kling et al. | |
| 2008/0189917 | A1 * | 8/2008 | Maley | 24/197 |
| 2008/0257928 | A1 | 10/2008 | Lowry et al. | |

FOREIGN PATENT DOCUMENTS

| | | | |
|---|---|---|---|
| AU | 621 372 | | 3/1992 |
| DE | 3537489 | A1 | 4/1987 |
| DE | 29704328 | U1 | 5/1997 |
| DE | 102004061661 | B3 | 2/2006 |
| EP | 0747095 | A2 | 11/1996 |
| GB | 191122130 | | 10/1912 |
| WO | 01/97917 | | 12/2001 |
| WO | 2005/048769 | | 6/2005 |

OTHER PUBLICATIONS

Search report under Section 17 for GB0907744.7, date of search Aug. 17, 2009, 2 pp.

* cited by examiner

*Primary Examiner* — Justin Larson
(74) *Attorney, Agent, or Firm* — DLA Piper LLP (US)

(57) ABSTRACT

A harness 100 for breathing apparatus, comprising: a structural support member 102 having a fixing portion 10, and at least one strap 40 having a loop 42. The strap is arranged to be releasably attached to the structural support member. The fixing portion comprises a first slot 12 through which a portion of the strap is arranged to pass in use; and a first anchor member 16, 18 laterally spaced from the first slot extending in a direction substantially parallel to the first slot and arranged in use to releasably locate at least partly within the loop of the strap through a first side of the loop.

9 Claims, 6 Drawing Sheets

HARNESS FOR BREATHING APPARATUS

This application is a utility application which claims the priority of United Kingdom Patent Application No. GB 0907744.7, filed May 6, 2009 incorporated herein by reference in its entirety.

BACKGROUND OF THE INVENTION

The present invention relates to a harness for breathing apparatus, in particular, a harness for breathing apparatus comprising a structural support member to which a strap is arranged to be releasably attached.

Self-contained breathing apparatus (SCBA) harnesses comprise a structural support member, usually in the form of a back plate or frame to which a cylinder of breathable gas is mounted. Typically two flexible shoulder straps are each attached at a first end to an upper portion of the back plate and at a second end to a lower portion of the back plate. A flexible waist strap (or belt) is also attached to the back plate. This enables the harness to be carried on the back of a user.

In a previously considered arrangement, a shoulder strap is attached to the back plate using a fixing part attached to the shoulder strap and a groove and opening in the back plate. The fixing part comprises a lug and a spring loaded detent. To attach the shoulder strap to the harness the lug is slid into the groove which causes the detent to be depressed. When the detent is aligned with the opening it springs out, locking the shoulder strap to the back plate. In order to detach the shoulder strap the detent must be pressed down and the lug slid out of the groove.

Whilst this arrangement is satisfactory for some applications, it has a number of drawbacks. The fixing part must be attached directly to the shoulder strap. This is usually done by stitching which can in some circumstances compromise the strength of the strap. In addition to this, the spring-loaded arrangement of the detent requires a number of moving parts and therefore the assembly is quite expensive. The above described fixing arrangement is therefore not particularly suitable for low-cost harnesses.

SUMMARY OF THE INVENTION

According to one aspect of the present invention there is provided a harness for breathing apparatus, comprising: a structural support member having a fixing portion, and at least one strap having a loop; wherein the strap is arranged to be releasably attached to the structural support member; the fixing portion comprising: a first slot through which a portion of the strap is arranged to pass in use; and a first anchor member laterally spaced from the first slot extending in a direction substantially parallel to the first slot and arranged in use to releasably locate at least partly within the loop of the strap through a first side of the loop.

The fixing portion may further comprise a second anchor member laterally spaced from the first slot extending in a direction substantially parallel to the first slot and arranged in use to releasably locate at least partly within the loop of the strap through a second opposed side of the loop.

In one embodiment the fixing portion further comprises a second slot laterally spaced from, and substantially parallel to, the first slot, wherein the anchor member extends from an end of the second slot.

The loop of the strap may comprises a folded portion of the strap.

In a preferred embodiment the strap further comprises a resilient barbed portion arranged in use to inhibit withdrawal of the strap from the first slot. The resilient barbed portion may comprise a folded portion of the strap, and is preferably spaced from the loop.

According to another aspect of the present invention there is provided a harness for breathing apparatus, comprising: a structural support member having a fixing portion; and at least one strap, wherein the strap is arranged to be releasably attached to the structural support member; the fixing portion comprising: a first slot through which a portion of the strap is arranged to pass in use; and wherein the strap comprises a resilient barbed portion arranged in use to inhibit the withdrawal of the strap from the first slot.

The barb may comprise a folded portion of the strap.

In one embodiment the strap further comprises a loop and the fixing portion further comprises a first anchor member laterally spaced from the first slot extending in a direction substantially parallel to the first slot and arranged in use to releasably locate at least partly within the loop of the strap through a first side of the loop. The fixing portion may further comprise a second anchor member laterally spaced from the first slot extending in a direction substantially parallel to the first slot and arranged in use to releasably locate at least partly within the loop of the strap through a second opposed side of the loop.

In one embodiment the fixing portion further comprises a second slot laterally spaced from, and substantially parallel to, the first slot, wherein the anchor member extends from an end of the second slot.

The loop of the strap may comprise a folded portion of the strap and is preferably spaced from the resilient barbed portion.

The strap may be a shoulder strap, a waist strap or a cylinder-retaining strap.

The invention may comprise any combination of the features and/or limitations referred to herein, except combinations of such features as are mutually exclusive.

BRIEF DESCRIPTION OF THE DRAWINGS

Embodiments of the present invention will now be described, by way of example only, with reference to the accompanying drawings, in which.

DESCRIPTION OF THE EMBODIMENTS OF THE INVENTION

Figure 1:
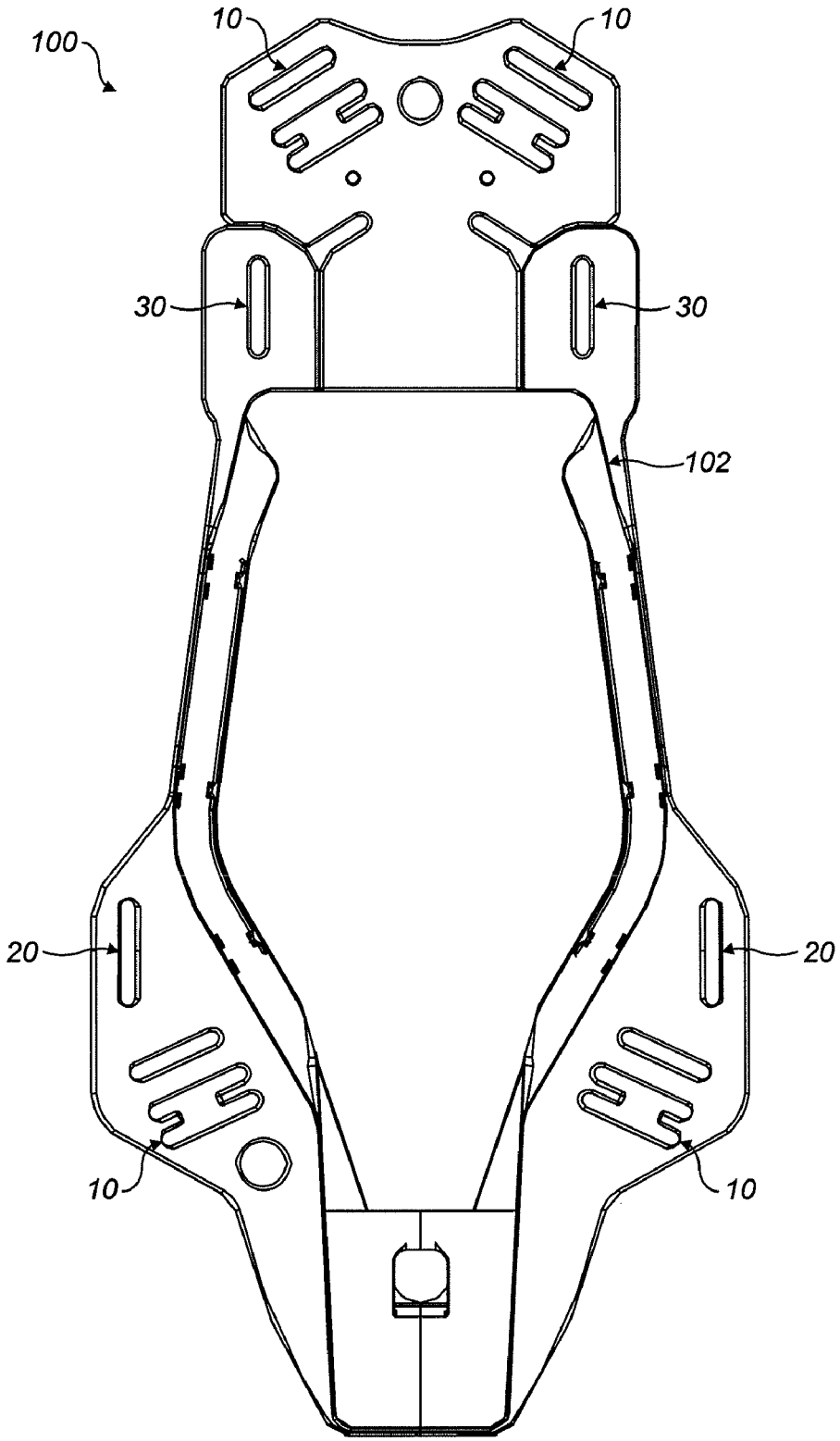
FIG. 1 schematically shows a structural support member of a harness for breathing apparatus in the form of a back frame having fixing portions.

FIG. 1 shows a back frame portion (otherwise known as a back plate) 102 of a harness 100 for breathing apparatus. The back frame 102 is a structural support member for a cylinder of breathable gas (not shown). The back frame 102 is provided with a number of fixing portions that allow straps to be releasably attached to the back frame 102.

A lower portion of the back frame 102 is provided with left and right shoulder strap fixing portions 10 for attaching the lower ends of two shoulder straps (not shown in this diagram). An upper portion of the back frame 102 is also provided with left and right shoulder strap fixing portions 10 for attaching the upper ends of the two shoulder straps. The back frame 102 also comprises left and right waist strap fixing portions 20 and left and right cylinder retaining strap fixing portions 30.

Figure 2:
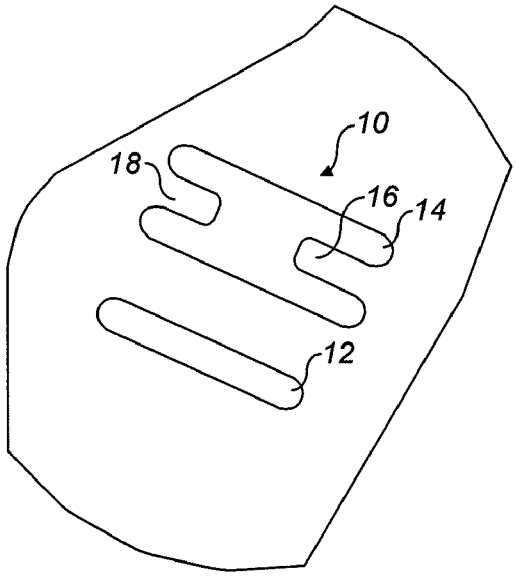
FIG. 2 schematically shows in enlarged view a shoulder strap fixing portion of the structural support member of FIG. 1.

An enlarged view of a shoulder strap fixing portion 10 is shown in FIG. 2. The fixing portion 10 comprises a first slot 12 and a second slot 14 that is laterally spaced from, and extends substantially parallel to the first slot 10. The second slot 14 is significantly wider than the first slot 12. Anchor members 16, 18, in the form of prongs, extend from each side of the second slot 14 towards each other leaving a gap between the anchor members. The anchor members 16, 18 are substantially parallel to the first and second slots 12, 14.

The lower portion of the back frame 102 is also provided with left and right waist belt fixing portions 20 and the upper portion of the back frame is provided with a cylinder retaining strap fixing portion 30.

Figure 3:
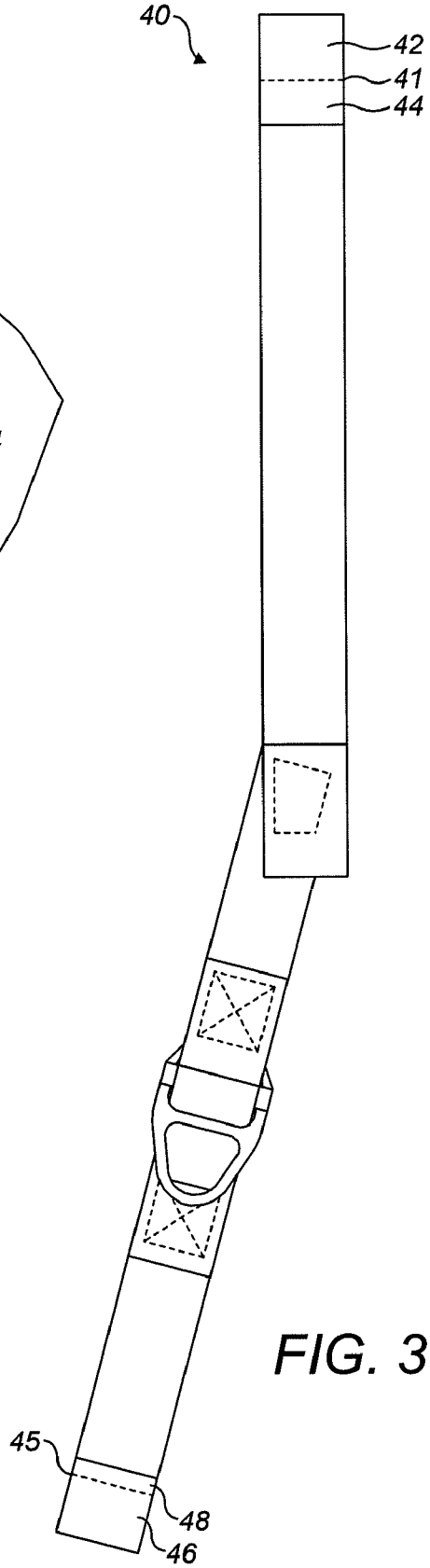
FIG. 3 schematically shows a shoulder strap.

FIG. 3 shows a shoulder strap 40 having a loop 42 and a resilient portion 44 (hereinafter referred to as a barb) at an upper end, and a loop 46 and a barb 48 at a lower end. The loops 42, 46 and the barbs 44, 48 are formed by folding over a portion of the strap and stitching a seam 41, 45 along a line parallel to the fold.

Figure 4:
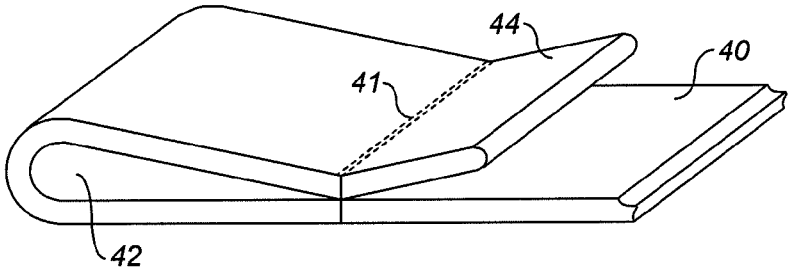
FIG. 4 schematically shows in perspective view a folded loop of the strap of FIG. 3.

FIG. 4 shows an enlarged view of the upper end of the shoulder strap 40. This shows the loop 42, the barb 44, and the stitched seam 41 in detail.

Figure 5:
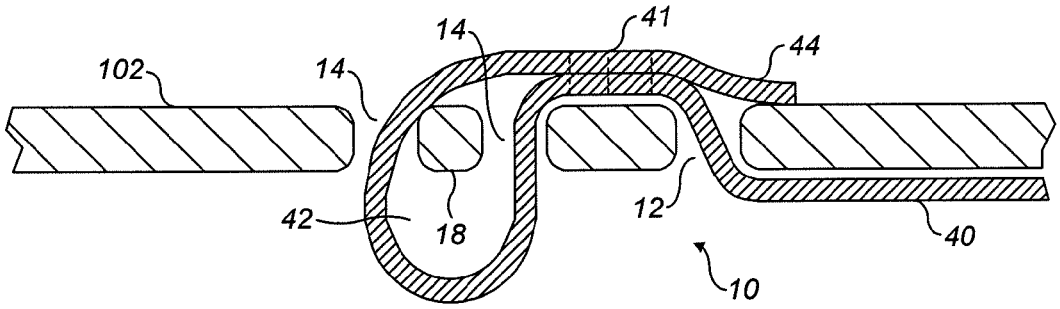
FIG. 5 shows schematically in section the shoulder strap of FIGS. 3 and 4 attached to the fixing portion of FIG. 2.

Referring now to FIG. 5, the end of the shoulder strap 40 can be attached to the back frame 102 of a harness 100 using the fixing portion 10. The loop 42 of the strap is passed through the first slot 12 and a portion of the strap 40 is pulled through at least until the barb 44 has passed completely through the first slot 12. The loop 42 is then located within the second slot 14 such that the anchor members 16, 18 engage within the loop 42. The end of the strap is now securely attached to the back frame 102. The same process is repeated with the other end of the strap and with the other strap.

The barb, being formed from a folded portion of the strap which is then retained by stitching, is resiliently biased away from the rest of the strap material, and without manually pressing it flat against the strap it will not slip back through the slot 12.

The connection between the strap 40 and the back frame 102 is capable of carrying a load. When the tension is applied to the strap 40 the barb 44 prevents the strap 40 from being pulled through the first slot 12. In this embodiment it is the barb 44 that carries the load. The anchor members 16, 18 provide an additional level of security. For example, if the barb 44 were to be accidentally pushed through the first slot 12 the anchor members 16, 18 would be able to carry the load. As will be readily apparent to one skilled in the art, in other embodiments it may be possible to omit the barb 44 in which case the load would be transmitted from the strap 40 to the back frame 102 via the loop 42 and anchor members 16, 18.

In order to detach the shoulder strap 40 from the back frame 102 the loop 42 is first disengaged from the anchor members 16, 18. The barb 44 must then be carefully pressed flush with the main strap portion 40 and fed through the first slot 12.

Figure 6:
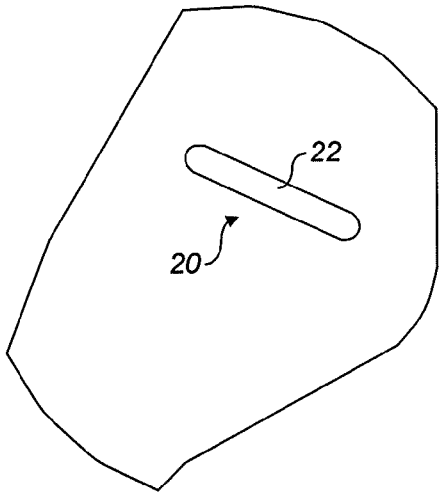
FIG. 6 schematically shows in enlarged view a waist strap fixing portion of the structural support member of FIG. 1.

An enlarged view of a waist belt fixing portion 20 is shown in FIG. 6. The fixing portion 20 comprises a single elongate slot 22. The cylinder retaining strap fixing portions 30 are identical to the waist belt fixing portion 20.

Figure 7A:
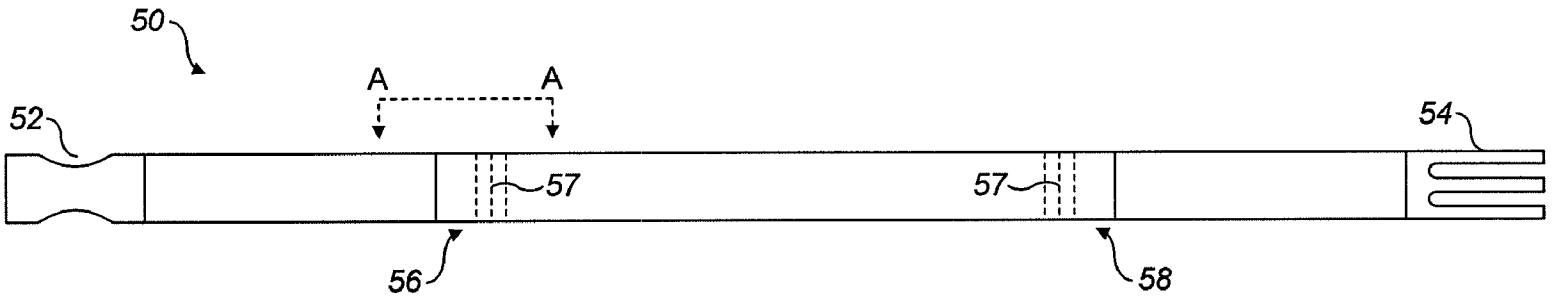
FIG. 7 schematically shows a waist strap.
Figure 7B:
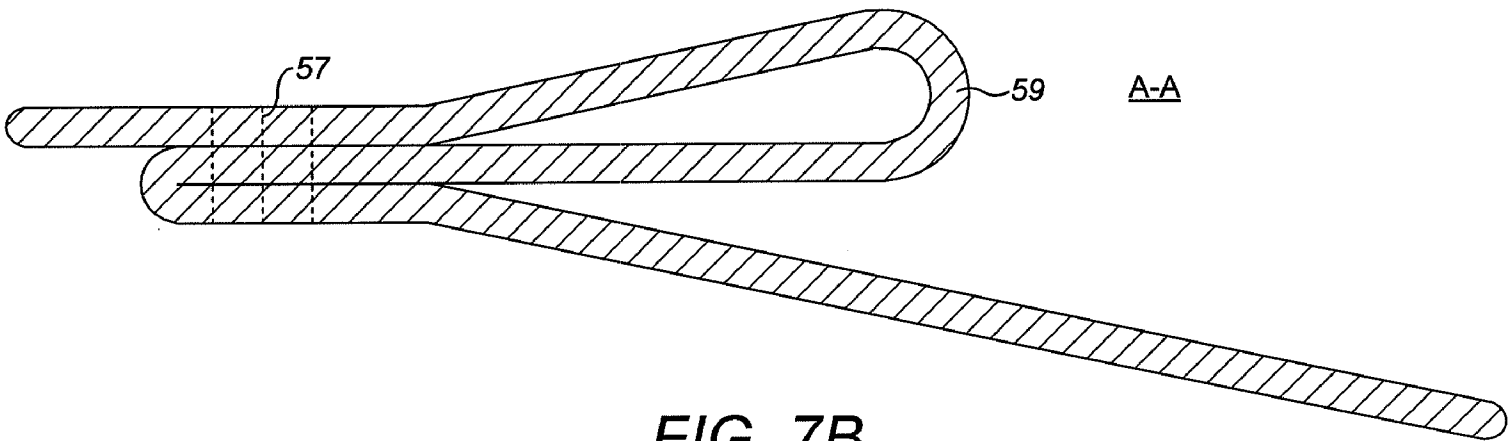

FIG. 7A shows a waist strap 50 having a snap-fit coupling 52, 54 at either end such that the strap can be attached round a wearer. The waist strap 50 also comprises first and second folded portions 56, 58 which are mirror images of one another. As shown more clearly in FIG. 7B, the waist strap 50 is folded once to form a barb 59 and is then folded back on itself. The folded portion is then stitched 57 to secure it.

Figure 8:
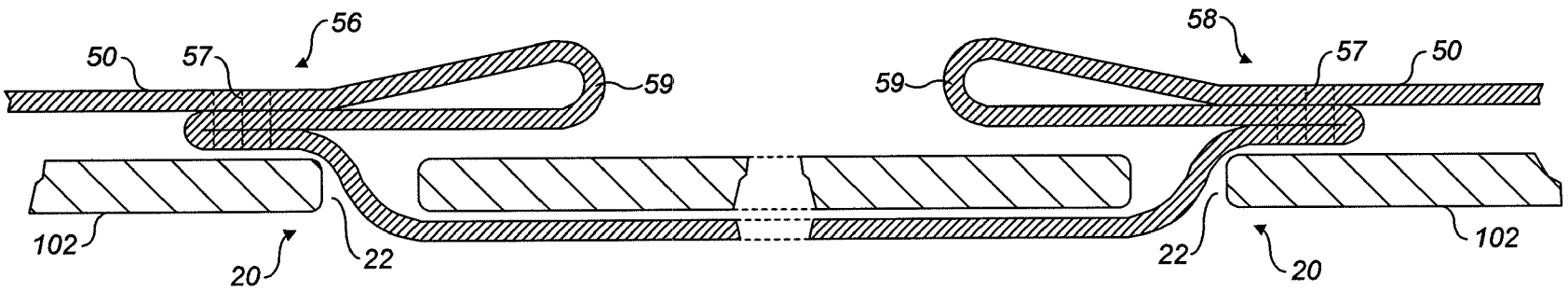
FIG. 8 shows schematically in section the waist strap of FIG. 7 attached to the fixing portion of FIG. 6.

With reference to FIG. 8, the waist strap 50 can be attached to the back frame 102 of a harness 100 using the right and left fixing portions 20. An end of the waist strap 50 is passed through the slot 22 of the right fixing portion 20. As the waist strap 50 is pulled further through the slot the barb 59 of the first folded portion 56 inhibits the return of the strap 50 through the slot 22. The same end of the waist strap 50 is then passed through the slot 22 of left fixing portion 20. Once the barb 59 of the second folded portion 58 has been pulled through the slot 22 the waist strap is securely held. The waist strap 50 cannot be pulled to the right (of FIG. 8) due to the barb 59 of the first folded portion 56 and cannot be pulled to the left (of FIG. 8) due to the barb 59 of the second folded portion 58. In order to detach the waist strap 50 from the back frame 102 the barbs 59 must be pressed flush with the strap and fed through the slots 22.

A cylinder retaining strap can be attached to the back frame 102 using the fixing portions 30 in a similar manner as described above for the waist strap 50.

As will be readily apparent to one skilled in the art, in other embodiments the shoulder strap fixing portions 10 could be the same as the waist belt fixing portion 20. Similarly, the waist belt fixing portions 20 or the cylinder retaining strap fixing portions 30 could be the same as the shoulder strap fixing portions 20.

Figure 9:
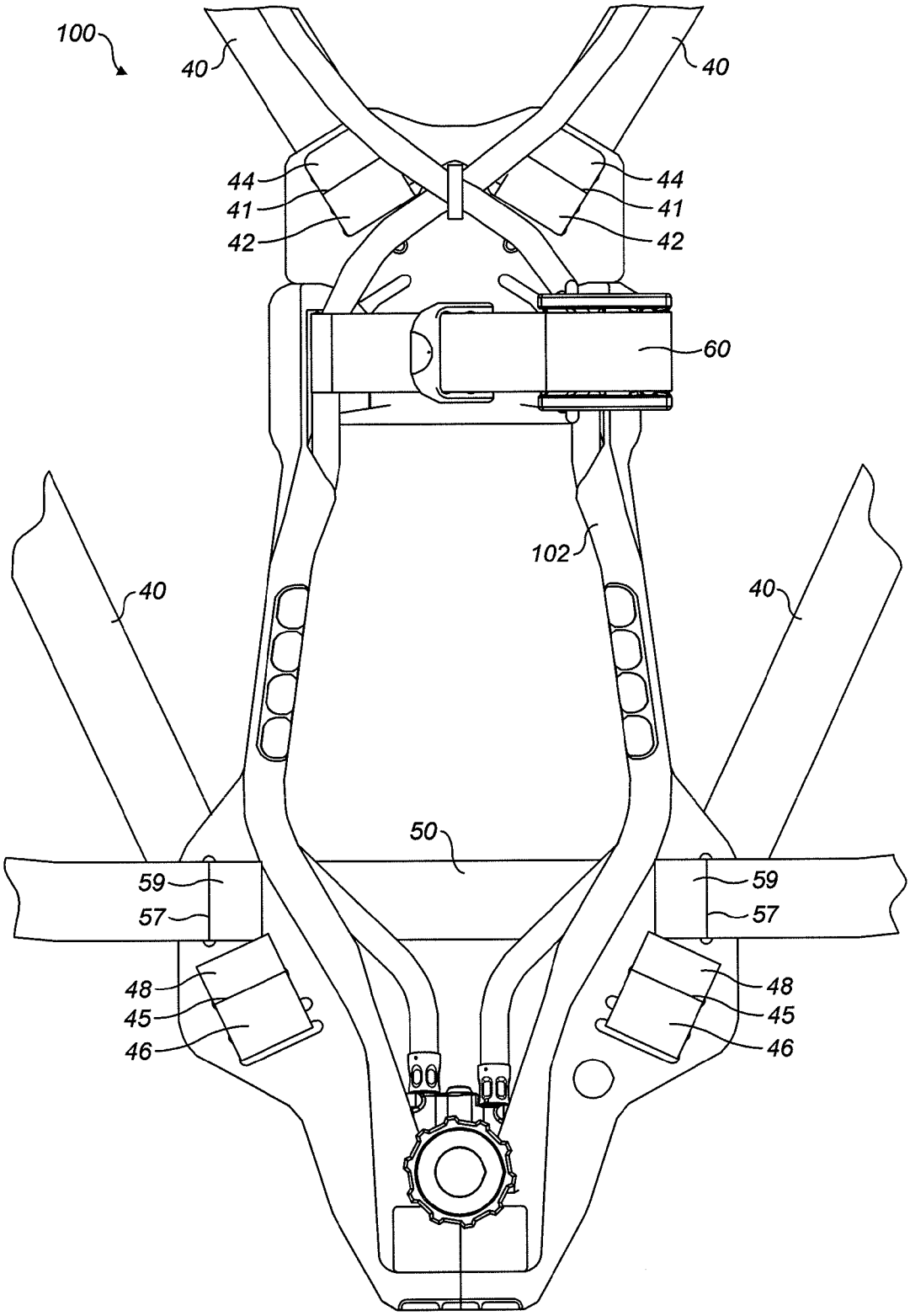
FIG. 9 schematically shows a harness for breathing apparatus having a number of straps attached.

FIG. 9 shows the back frame 102 with two shoulder straps 40, a waist strap 50 and a cylinder retaining strap 60 attached using the various fixing portions 10, 20, 30. The straps 40, 50, 60 can be attached and detached both quickly and easily from the back frame 102. The fixing portions 10, 20, 30 are easy to form and can for example be either machined out of the back frame 102 or moulded. The loops 42, 46 and barbs 44, 48, 59 of the straps can be formed simply by folding and stitching the strap material. The fixing between the straps and the back frame comprises no moving parts that could fail or seize. This provides an extremely reliable, versatile, lightweight, inexpensive and safe connection.

The invention claimed is:

1. A harness for breathing apparatus, comprising:

a structural support member having a fixing portion; and at least one strap having a loop and a barbed portion which is resiliently biased away from the rest of the strap, wherein the strap is arranged to be releasably attached to the structural support member;

the fixing portion comprising:

a first slot through which a portion of the strap is arranged to pass in use; and a first anchor member laterally spaced from the first slot and extending in a direction substantially parallel to the first slot and arranged in use to releasably locate at least partly within the loop of the strap through a first side of the loop, wherein the barbed portion is arranged to inhibit the withdrawal of the strap from the first slot.

2. A harness for breathing apparatus according to claim 1, wherein the barbed comprises a folded portion of the strap.

3. A harness for breathing apparatus according to claim 1, wherein the fixing portion further comprises a second anchor member laterally spaced from the first slot extending in a direction substantially parallel to the first slot and arranged in use to releasably locate at least partly within the loop of the strap through a second opposed side of the loop.

4. A harness for breathing apparatus according to claim 1, wherein the fixing portion further comprises a second slot laterally spaced and substantially parallel to the first slot, wherein the anchor member extends from an end of the second slot.

5. A harness for breathing apparatus according to claim 1, wherein the loop of the strap comprises a folded portion of the strap.

6. A harness for breathing apparatus according to claim 1, wherein the loop is spaced from the barbed portion.

7. A harness for breathing apparatus according to claim 1, wherein the strap is a shoulder strap.

8. A harness for breathing apparatus according to claim 1, wherein the strap is a waist strap.

9. A harness for breathing apparatus according to claim 1, wherein the strap is a cylinder-retaining strap.

* * * * *